United States Patent [19]

Patterson, III et al.

[11] 4,025,052

[45] May 24, 1977

[54] CLAMPS FOR WIRE ROPE, RODS AND TUBES

[76] Inventors: W. W. Patterson, III; Eugene F. Grapes, both c/o W. W. Patterson Co., 830 Brocket St., Pittsburgh, Pa. 15233

[22] Filed: July 15, 1976

[21] Appl. No.: 705,526

[52] U.S. Cl. ..... 254/76; 24/134 R

[51] Int. Cl.[2] ..... B66F 3/00

[58] Field of Search ..... 254/76, 79, 106; 24/132 WL, 134 E, 134 EA, 134 KD, 134 L, 134 N, 249 WL

[56] References Cited

UNITED STATES PATENTS

| | | | |
|---|---|---|---|
| 3,142,879 | 8/1964 | Faure | 254/76 |
| 3,886,631 | 6/1975 | Caradot | 24/134 N |

FOREIGN PATENTS OR APPLICATIONS

| | | | |
|---|---|---|---|
| 1,380,406 | 1/1975 | United Kingdom | 254/76 |

*Primary Examiner*—Al Lawrence Smith
*Assistant Examiner*—Robert C. Watson
*Attorney, Agent, or Firm*—Buell, Blenko & Ziesenheim

[57] ABSTRACT

A clamp for wire rope, rods and tubes and a load fastening apparatus are provided including an elongated strand of given length, a clamp means adjustably positioned on said elongated strand intermediate its length, fastening means on one end of said strand spaced from the clamp means, said clamp engaging the strand selectively on movement of the strand in one direction relatively thereto and releasing the strand on movement of the strand in the opposite direction, a hollow screw member surrounding the strand and bearing on the clamp and nut means acting on said hollow screw, one of said nut and screw acting on a load to adjust the clamp position relative to said load and the fastening means.

9 Claims, 8 Drawing Figures

CLAMPS FOR WIRE ROPE, RODS AND TUBES

This invention relates to clamps for wire rope, rods and tubes and particularly to load binders utilizing a quickly adjustable clamp capable of either pulling or pushing to bind or hold a load.

Load binders of the chain link type have long been known. More recently, with the advent of the wire rope type of load binder, difficulties have arisen because of the inability of existing wire rope clamps to maintain an adequate grip on the wire rope.

In U.S. Pat. No. 3,395,892, issued Aug. 6, 1968, a so-called "over-center load binder and gripping device" is disclosed. This device is difficult to operate because of the over-center toggle arrangement employed.

We provide several embodiments of load binder apparatus including a preferred embodiment of apparatus, in which a slack take-up device functions cooperatively with the body of a clamp device.

We provide a preferred embodiment of apparatus in which a floating screw and nut assembly is detachably secured to the body of a wire rope clamp.

Our invention also provides various combinations of load binder and accessories for pushing and pulling on loads to hold or bind them in place.

The apparatus of our invention can be used to pull a load, lift a load, bind a load, bundle a load, clamp a load, compress a load, brace a load, jack a load, lower a load and tension a load.

In the foregoing general outline of our invention we have set out certain objects, purposes and advantages of our invention. Other objects, purposes and advantages will be apparent from a consideration of the following description and accompanying drawings in which.

Figure 1:
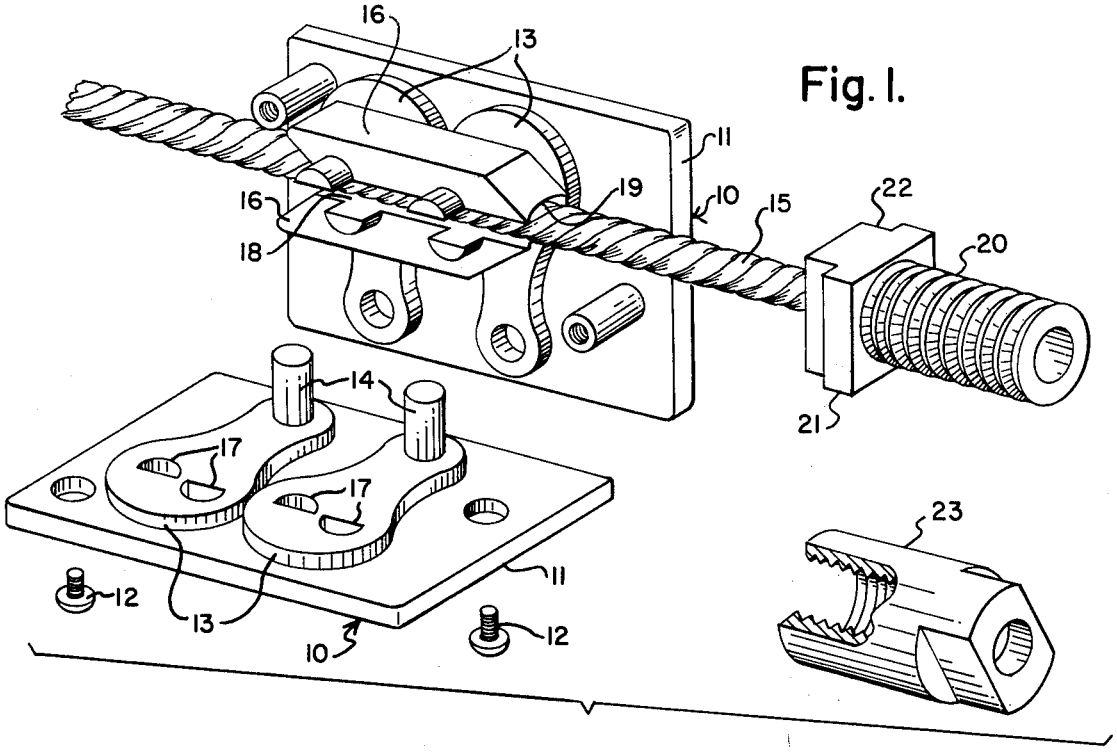
FIG. 1 is an exploded section view through a binder clamp and floating screw and nut of this invention.

Referring to the drawings we have illustrated in FIG. 1 a load clamp 10 having a body 11 in generally rectangular form. The cover for one side is removed but is normally held in position by a plurality of screws 12. Within the body 11 are a pair of generally parallel arms 13, each pivotally mounted at one end in the body on pins 14. The arms 13 are bifurcated and straddle a strand 15 extending through the body. The strand 15 may be a tubular member, a rod, a wire rope or the like. The strand 15 enters the body 10 at one end and passes between semi-cylindrical elements 16 having semi-cylindrical transverse pins **16*a* disposed in staggered transverse semi-circular openings 17 in the arms 13. The openings 17 have a diameter slightly larger than the diameter of pins 16*a* so that there is both rotational movement of pins 16*a* in openings 17 as well as axial movement along the strand axis. This permits the members 16 to move toward and away from each other under the frictional engagement of the strand 15 with rotation arms 13 whereby the strand 15 is automatically engaged and released by members 16 depending on the direction of its movement. The flat faces 18 of cylindrical elements 16 contain curved recesses 19 conforming to the cross section of strand 15. A floating hollow screw 20 having a head 21 with lands 22 adapted to rest between and bear on frame 10 is provided around strand 15. A nut 23 is threaded on the screw 20**.

Figure 2:
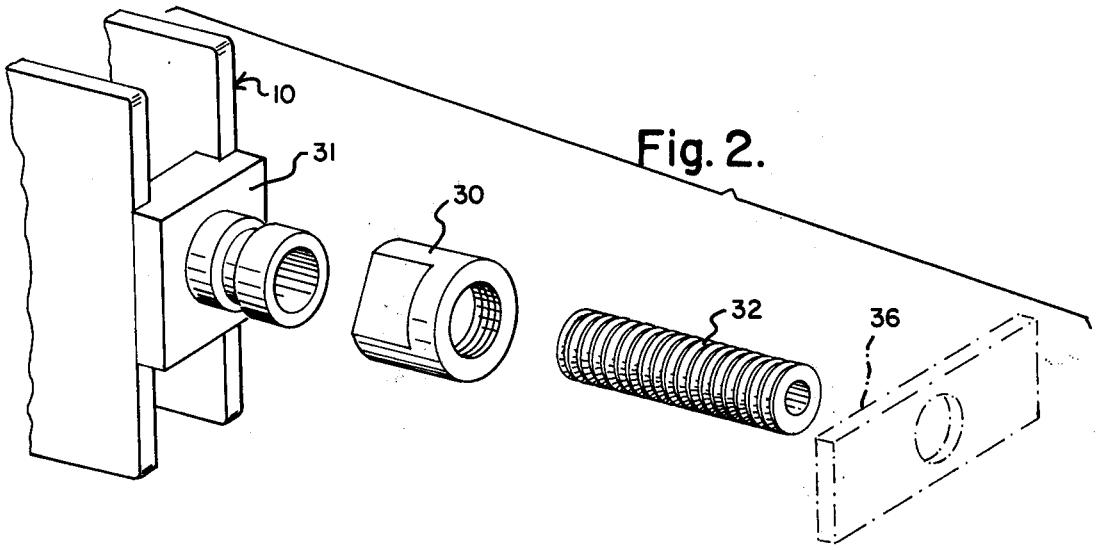
FIG. 2 is a second embodiment of load binder.

In the modification shown in FIG. 2 a nut 30 rotatably keyed on fixed head 31 and having a hollow screw 32 threaded therein is substituted for the floating hollow screw 20 of FIG. 1.

Figure 3:
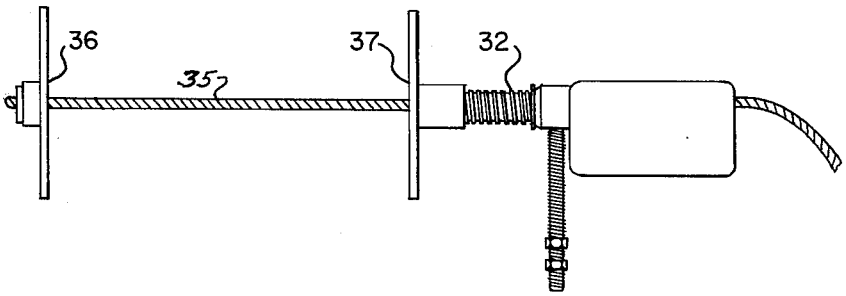
FIG. 3 is a side elevational view of the load binder clamp of this invention assembled for restraining or compressing a load.

In FIG. 3 we have illustrated the clamp of FIG. 2 used in conjunction with a wire rope 35 having a plate 36 at one end. A plate 37 is rotatably mounted on the screw 32. This arrangement is used to restrain or compress a load between plates 36 and 37.

Figure 4:
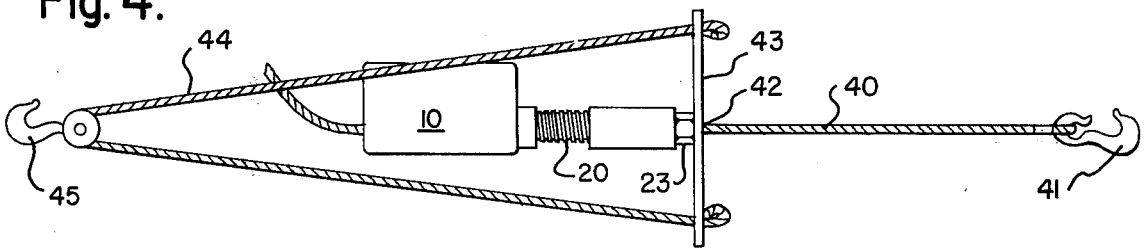
FIG. 4 is a side elevational view of the load binder clamp of this invention assembled for pulling or binding and tensioning a load.

The embodiment of FIG. 4 illustrates the clamp of FIG. 1 used in conjunction with a wire rope 40 having a hook 41 at one end. The wire rope 40 passes through a hole 42 in plate 43 against which nut 23 bears. Plate 43 is fixed at opposite ends to the ends of a cable 44 passing through hook sheave 45. This arrangement is used for tying loads into a bundle, for binding a load on a vehicle and for tensioning. It is used by drawing the rope 40 through clamp 10 with nut 23 rim down on screw 20 and then rotating nut 23 to exert pressure on rope 20.

Figure 5:
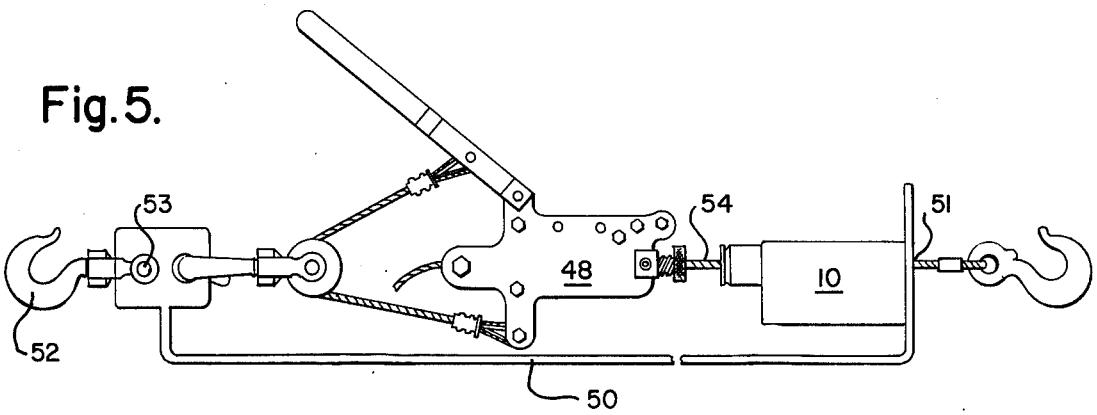
FIG. 5 is a side elevational view of the load binder clamp of this invention in double arrangement.

In FIG. 5, we have illustrated the clamp, identified as pulling clamp 48, of FIG. 1 used in conjunction with a second clamp 10 in the form illustrated in FIG. 1 of our parent application Ser. No. 399,826. In this form a generally U-shaped carrier 50 having an opening 51 at one end and a swivel hook 52 and opening 53 at the other is fitted with the clamp 48 of FIG. 1 of Ser. No. 399,826 to act to pull a wire rope 54 through clamp 10 which locks the wire rope each time it is pulled until a sufficiently tight binding is achieved. The pulling clamp 48 is then removed leaving the clamp 10 locked on the wire rope to form a theft proof binding on a load.

Figure 6:
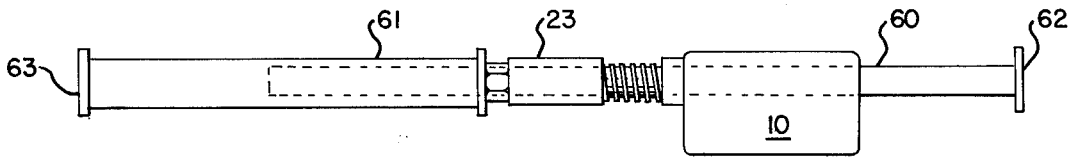
FIG. 6 is a side elevational view of the load binding clamp of this invention in a bracing or locking mode.

FIG. 6 illustrates clamp 10 used in conjunction with a hollow tubing or rod 60 instead of a wire rope passing through the clamp 10 and a hollow tube 61 at the opposite end connected to nut 23. The apparatus is used for shoring or bracing with pads 62 on tube 60 and tube 63 on tube 61 bearing against the two opposite parts being braced and the final tightening being effected by turning nut 23 or screw 20.

Figure 7:
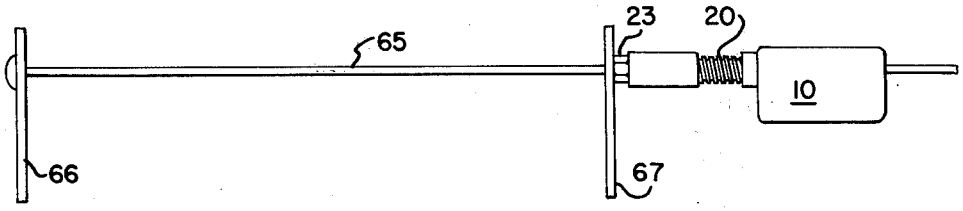
FIG. 7 is a side elevational view of the load binding clamp of this invention in a second load clamping or locking mode.

In FIG. 7 a rod 65 is passed through spaced plates 66 and 67 and through clamp 10 in place of a wire rope or cable. A load to be clamped is placed between plates 66 and 67 and rod 65 pulled through clamp 10. Final tightening is effected by turning nut 23 on screw 20 to force plate 67 toward plate 66.

Figure 8:
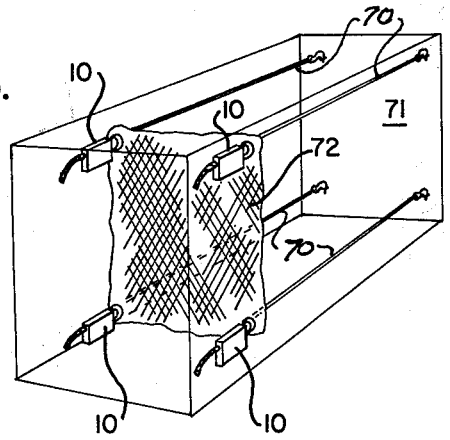
FIG. 8 is a side elevational view of the load binder clamp of this invention assembled in multiples for compressing and locking a load.

In FIG. 8 we have shown four clamps 10 and cables 70 attached to four corners of two spaced plates 71 and 72. The cables 70 are drawn through clamps 10 until tight with a load between plates 71 and 72 and nut 23 turned on screw 20 to accomplish final tightening.

Instead of a plate 72, we may use a mesh closure made of wire, rope mesh, etc.

As can be seen from the foregoing specification this invention can be used in a variety of ways and in a variety of combinations to produce pulling, pushing, clamping and the like forces. Accordingly, it will be understood that the invention may take various forms within the scope of the following claims.

We claim:

1. A clamp for cable, rods and tubes comprising a housing, means in said housing engaging said cable, rod and tube on movement of said cable, rod and tube through said housing in one direction and releasing the same on movement in the opposite direction, a hollow screw adapted removably to bear on the housing and surround said cable rod and tube at either side of said housing and nut means acting on said hollow screw, one of said nut and screw acting on a load to adjust the housing with respect to said load.

2. A clamp for cable, rods and tubes as claimed in claim 1 wherein the hollow screw is provided with lands fitting the housing to hold it against rotation and the nut means moves along said screw toward and away from the housing.

3. A clamp for cable, rods and tubes as claimed in claim 1 wherein the nut is rotatable on a fixed head having lands fitting the housing and the hollow screw moves longitudinally within the nut toward and away from the housing.

4. A load fastening apparatus comprising an elongated strand of given length, a clamp means adjustably positioned on said elongated strand intermediate its length, fastening means on one end of said strand spaced from the clamp means, said clamp engaging the strand selectively on movement of the strand in one direction relatively thereto and releasing the strand on movement of the strand in the opposite direction, a hollow screw member surrounding the strand and bearing on the clamp and nut means acting on said hollow screw, one of said nut and screw acting on a load to adjust the clamp position relative to said load and the fastening means.

5. A load fastening apparatus as claimed in claim 4 wherein the fastening means is a flat metal plate fixed to said one end of said strand and the nut and screw carry a second flat metal plate surrounding the strand.

6. A load fastening apparatus as claimed in claim 4 wherein the strand is a cable and the fastening means is a hook fixed to said one end of said cable and the nut and screw carry a generally flat plate surrounding the cable between the clamp and fastening means and a second cable means carry a sheave hook intermediate its ends and having its ends fixed to the flat plate on opposite sides of the cable.

7. A load fastening apparatus as claimed in claim 4 wherein the strand is a rod and the fastening means is a plate on said one end of said rod and the nut and screw carry a hollow tube surrounding the other end of the rod and is provided with a flat plate on the end remote from the clamp.

8. A load fastening apparatus as claimed in claim 5 wherein the strand is a rod.

9. A load fastening apparatus as claimed in claim 5 wherein the strand is a cable.

* * * * *